United States Patent [19]

Goloff

[11] 4,026,662

[45] May 31, 1977

[54] BEARINGS FOR SLANT AXIS ROTARY MECHANISMS

[75] Inventor: Alexander Goloff, East Peoria, Ill.

[73] Assignee: Caterpillar Tractor Co., Peoria, Ill.

[22] Filed: Oct. 23, 1975

[21] Appl. No.: 625,226

[52] U.S. Cl. ..... 418/53; 308/72; 308/237 R

[51] Int. Cl.² ..... F01C 21/02

[58] Field of Search ..... 418/49–53, 418/68; 308/237 R, 21, 72

[56] References Cited

UNITED STATES PATENTS

| | | | |
|---|---|---|---|
| 2,031,125 | 2/1936 | Peschl | 418/53 |
| 3,913,990 | 10/1975 | Eklund | 308/72 |
| 3,942,384 | 3/1976 | Parker | 418/53 |
| 3,945,776 | 3/1976 | Morita | 418/178 |
| 3,946,617 | 3/1976 | Moriarity | 308/72 |

FOREIGN PATENTS OR APPLICATIONS

| | | | |
|---|---|---|---|
| 588,508 | 3/1934 | Germany | 418/53 |

*Primary Examiner*—C. J. Husar

*Attorney, Agent, or Firm*—Wegner, Stellman, McCord, Wiles & Wood

[57] ABSTRACT

An improved slant axis rotary mechanism, such as an engine, compressor, pump, or the like, of the type having a housing with a chamber defined by a radially outward spherical wall, a radially inner spherical wall, and opposed generally radially extending side walls interconnecting the spherical walls. A shaft is journalled within the housing and has an angularly offset portion within the chamber. A rotor having a generally spherical hub is within the chamber and journalled on the shaft. The rotor hub has a raised bearing area in sliding engagement with the inner spherical surface of the housing. As a consequence, gas and thrust loads on the shaft and bearings journalling the same are shared by the housing to increase the useful life of the mechanism.

6 Claims, 6 Drawing Figures

BEARINGS FOR SLANT AXIS ROTARY MECHANISMS

BACKGROUND OF THE INVENTION

This invention relates to slant axis rotary mechanisms such as compressors, engines, pumps or the like. More specifically, the invention relates to improvements in such a mechanism to increase the fatigue life of the mechanism main shaft and bearings associated therewith.

The power output of a slant axis rotary mechanism employed as an engine is limited by bending stresses in the fillets of the mainshaft where the mainshaft joins the angularly offset portion or eccentric thereof. Similarly, the operating efficiency of such mechanisms operating as pumps or compressors is also limited.

The cause of the problem is two-fold. In a slant axis rotary mechanism, there is a large span between the mainshaft bearings which often is in excess of the hub sphere diameter of the rotor. In addition, a relatively small shaft diameter is employed, with the result that there is a large stress concentration at the fillets. Because, during operation of such mechanisms, there is a complete stress reversal fatigue life may be severely reduced.

As is well known, such mechanisms typically employ a thrust bearing on one end of the mainshaft. Thrust loads imposed on such a thrust bearing during operation of slant axis rotary mechanisms are rather large. Thus, a rather large thrust bearing must be employed and the same must be manufactured with high tolerance to insure proper operation.

SUMMARY OF THE INVENTION

It is the principal object of the invention to provide a new and improved slant axis rotary mechanism. More specifically, it is an object of the invention to provide such a mechanism wherein bending loads upon the mainshaft and thrust loads upon the thrust bearing are shared by loading other components to increase the fatigue life of the mechanism and to minimize the thrust bearing size and complexity.

An exemplary embodiment of the invention achieves the foregoing objects in a structure including a housing having a chamber defined by a radially outer spherical wall, a radially inner spherical wall, and opposed generally radially extending side walls interconnecting the spherical walls. A shaft is journalled within the housing and includes an angularly offset portion within the chamber. A rotor having a generally spherical hub is exposed within the chamber and journalled on the shaft. The rotor hub is provided with raised bearing areas in sliding engagement with the inner spherical surface of the housing so that thrust loads and bending loads normally imposed only on the mainshaft and on the thrust bearing are shared by the housing.

In one embodiment of the invention, the hub carries sealing means in engagement with the inner spherical wall to establish a seal between the hub and the inner spherical wall. The seals are separated from the raised bearing areas by regions on the hub spaced from the inner spherical wall. Thus, should scuffing of the bearing areas occur, it will not be transferred readily to the sealing means. According to a highly preferred embodiment of the invention, spaced compression and oil seals are employed and the bearing areas are disposed between such seals.

In one embodiment of the invention, the raised bearing areas are defined by an overlay of bearing material secured to the hub while, according to another embodiment of the invention, the raised bearing areas are formed of locally raised areas on the hub.

In a highly preferred embodiment of the invention, means are provided for adjusting the loading on the raised bearing areas. Such means may include eccentric housings for the main shaft bearings.

Other objects and advantages will become apparent from the following specification taken in connection with the accompanying drawings.

DESCRIPTION OF THE PREFERRED EMBODIMENTS

Figure 1:
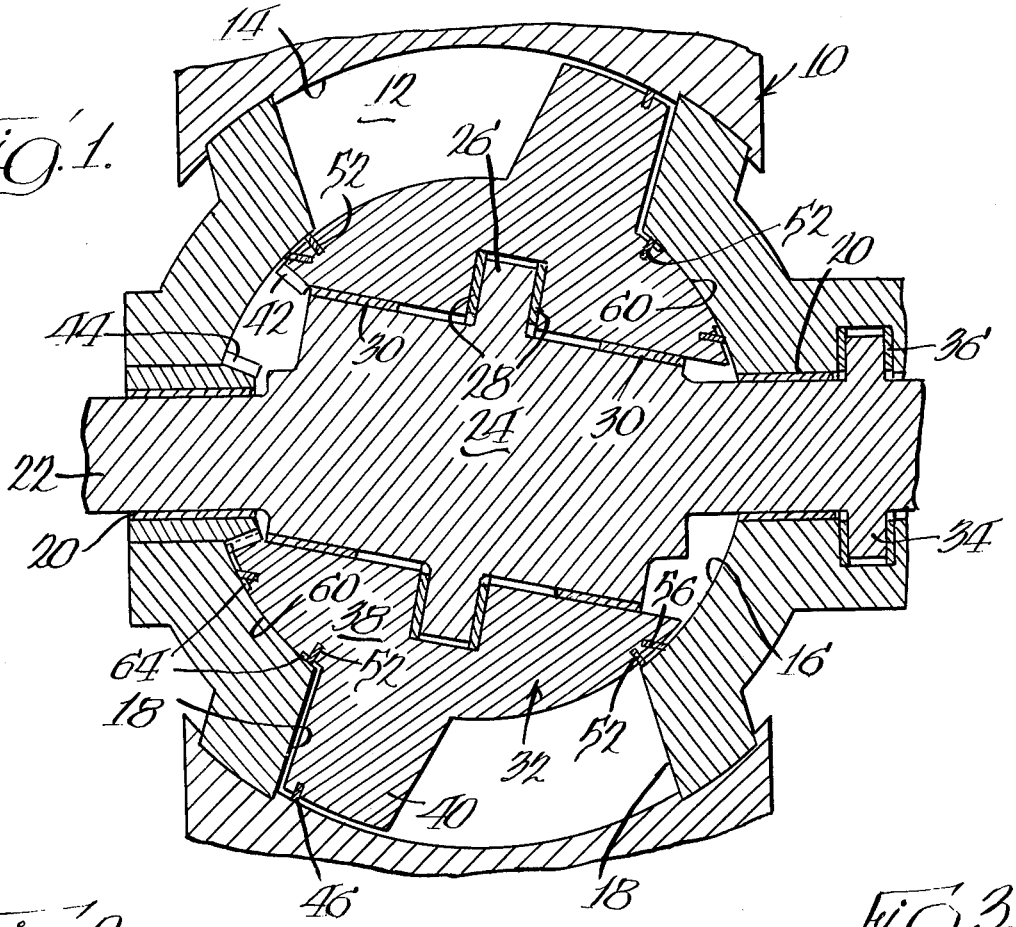
FIG. 1 is a sectional view of a slant axis rotary mechanism embodying the invention.

An exemplary embodiment of a slant axis rotary mechanism is illustrated in the drawing in the form of a four-cycle engine. However, it is to be understood that the principle of the invention is applicable to slant axis rotary mechanisms employed in uses other than as engines, such as pumps, compressors or the like. It is also to be understood that the invention is not limited to four-cycle mechanisms, but may be employed in such mechanisms operating on differing numbers of cycles.

With reference to FIG. 1, the mechanism includes a housing, generally designated 10, defining a chamber 12. The chamber 12 is bounded by a radially outer spherical wall 14 and a radially inner spherical wall 16 interconnected by opposed, generally radially extending side walls 18.

Bearings 20 journal a shaft 22 within the housing 10 such that an angularly offset portion or eccentric 24 thereof is disposed within the chamber 12. The angularly offset portion includes a peripheral thrust collar 26 and by means of thrust bearings 28 and journal bearings 30, journal a rotor 32 within the chamber 12.

The shaft 22 also carries a further thrust collar 34 exteriorly of the chamber received in thrust bearings 36 supported by the housing 10. The rotor 32 has a spherical hub 38 and a peripheral, radially outwardly extending flange 40. An internal ring gear 42 on one end of the hub 38 is meshed with a timing gear 44 carried by the housing 10 to establish the proper timed relation between shaft and rotor motion.

The radially outer periphery of the flange 40 carries peripheral seals 46 which engage and seal against the radially outward spherical wall 14. Piston seals 48 (sometimes termed "bolts") are located at the juncture of the peripheral seals 46 and carry radially extending apex seals 50 which engage a corresponding one of the radially extending side walls 18.

Figure 2:
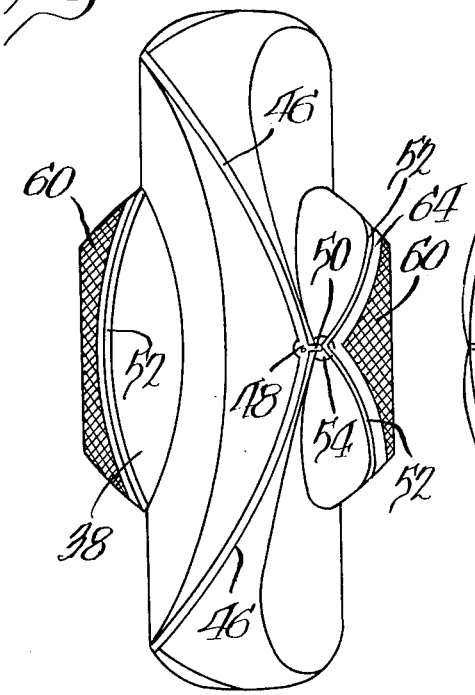
FIG. 2 is an elevational view of a rotor employed in the mechanism.
Figure 3:
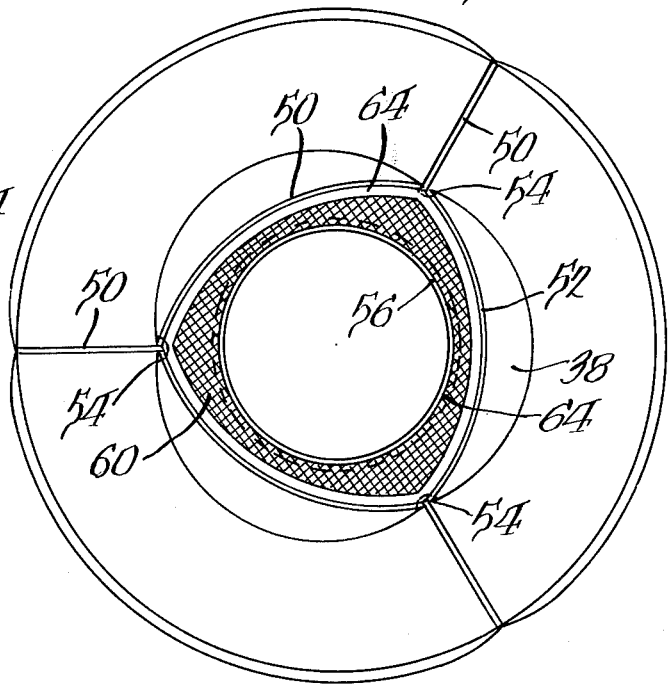
FIG. 3 is a further elevational view of the rotor taken at approximately 90° to the view of FIG. 2.

The hub 38 of the rotor 32, on both ends thereof, carries compression seals 52 as well as piston seals 54 at the juncture of the compression seals 52. The configuration of the compression seals 52 is substantially as illustrated in FIGS. 2 and 3 and is dictated by the need to maintain engagement of each seal 52 with the radially inner spherical wall 16 for all positions of the rotor 32 within the chamber 12 while minimizing parasitic volume. Each end of the hub 38 also carries an oil seal 56 which is circular in configuration. As is apparent, the compression seals 52 are spaced from the oil seals 56.

Figure 4:
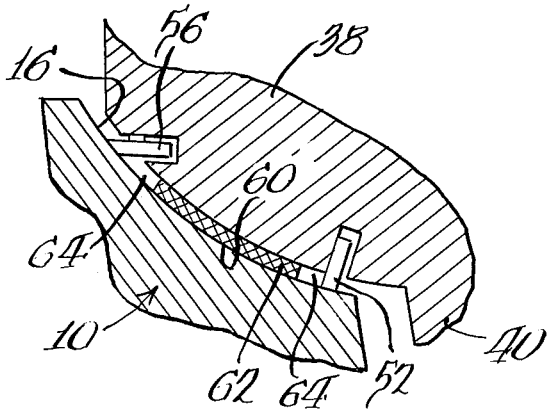
FIG. 4 is an enlarged, fragmentary sectional view of a portion of the mechanism.

In the preferred embodiment of the invention, both ends of the hub 38 are provided with raised islands 60 which slidably engage the radially inner spherical wall 16. As illustrated in FIGS. 2 and 3, the island areas are lightly hatched. The islands 60, by reason of their engagement with the radially inner spherical wall 16 of the housing, transfer much of the loading that otherwise would be applied to the shaft 22 and the thrust bearing defined by the collar 34 and bearings 36 to the housing 10. The islands 60 may be formed either by securing an overlay of bearing material to the hub 38 in the desired area or by locally raising the hub in the desired area. FIG. 4 illustrates the application of an overlay layer 62 to the hub 38. This approach typically will be employed when the hub is formed of, for example, steel. In such a case, the islands 60 may be provided by babbitting or by providing a cover of bronze which may be soldered or brazed in place. If the rotor is to be formed of a relatively light metal, such as an aluminum alloy, it is preferred to locally raise the surface to provide an aluminum bearing riding on a steel housing surface.

As illustrated in FIGS. 1–4, the islands 60 are disposed between the compression and oil seals 52 and 56 respectively. Consequently, they are not exposed to combustion gases if the mechanism is employed as an engine and will operate in a clean environment.

Figure 5:
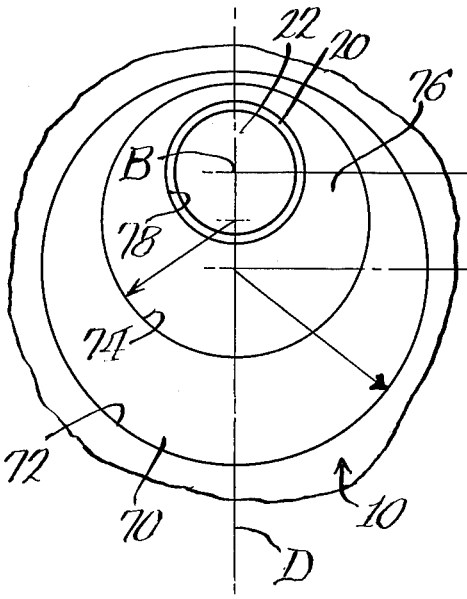
FIG. 5 is a somewhat schematic illustration of a preferred adjustable bearing in one possible configuration thereof.

It will also be observed from FIGS. 4 and 5, that the islands 60 are separated from the seals 52 and 56 by regions 64 of the hub surface which are spaced from the inner spherical wall 16. The purpose of this construction is as follows. If scuffing occurs during the operation of the mechanism, it will, more likely than not, originate at the bearing areas defined by the islands 60. Without the separation provided by the regions 64, such scuffing would immediately transfer to the surfaces of the seals 52 and 56 to cause premature seal wear. When such scuffing does not transfer, generally the result will only be the formation of harmless scratches on the engaging surfaces.

In a preferred embodiment of the invention, it is preferred that means be provided for adjusting the loading placed on the raised bearing areas or islands 60 during mechanism operation. According to one embodiment of the invention, such load adjustment is provided by adjusting built-in clearances between the hub sphere, the inner spherical wall, and in bearings. According to another embodiment of the invention, load adjustment is controlled by adjustably displacing, at the time of assembly, one or both of the bearings 20 to displace the shaft 22 from its theoretical center line. One means for providing such displacement of the bearings 20 to displace the shaft 22 is illustrated in FIG. 5. A bearing cage 70 is rotatably received in a bore 72 in the housing 10. The bearing cage 70 includes an eccentrically located bore 74 which receives a second bearing cage 76. The bearing cage 76 also includes an eccentrically located bore 78 in which the bearing 20 is disposed.

Figure 6:
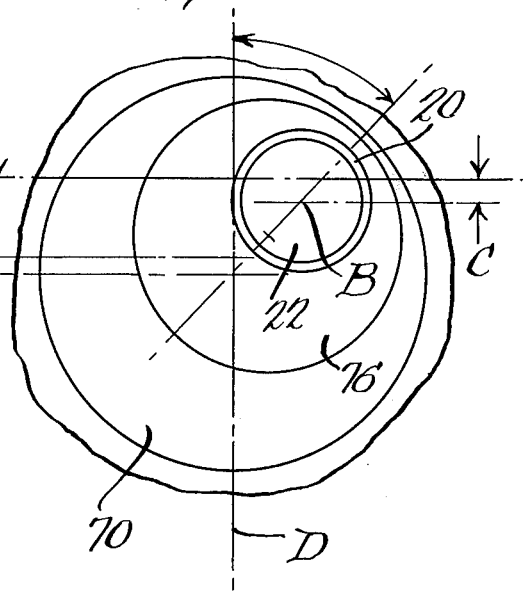
FIG. 6 is a view of the adjustable bearing of FIG. 5 in another configuration thereof.

Adjustment is achieved as follows: If it is assumed that the shaft center line designated point B is to be lowered to achieve a given loading, the bearing cage 70 may be rotated in either direction. FIG. 6 illustrates rotation of the cage 70 in a clockwise direction through 45°. This causes the point B to be lowered an increment C. To maintain the point B on a line D, by rotation of the bearing cage 76 in a counter-clockwise direction, the point B can again be disposed thereon. It will then be vertically displaced by the increment C. Alternately, if a greater displacement is desired, the bearing cage 76 may be rotated clockwise through 180°, at which time the point B will be on the line D, but lowered a vertical increment equal to E.

Thus, by selecting the varying degrees of rotation of the bearing cages 70 and 76, the center line of the shaft 22 at either end of the housing can be displaced to virtually any desired location to control the desired degree of loading carried by the islands 60.

From the foregoing, it will be appreciated that the slant axis rotary mechanism made according to the invention provides for a significant reduction in the bending load applied to the shaft 22 as well as the thrust load applied to the thrust bearing defined by the thrust collar 34 and bearing 36. Thus, the fatigue life of the apparatus is improved.

What is claimed is:

1. In a slant axis rotary mechanism, the combination of:
   - a housing having a chamber defined by a radially outer spherical wall, a radially inner spherical wall and opposed generally radially extending side walls interconnecting said spherical walls;
   - a shaft journalled within said housing and having an angularly offset portion within said chamber; and
   - a rotor having generally spherical hub within said chamber and journalled on said shaft, said rotor hub having raised bearing areas in sliding engagement with said inner spherical surface.

2. The slant axis rotary mechanism of claim 1 wherein said raised bearing areas are defined by an overlay of bearing material secured to said hub.

3. In a slant axis rotary mechanism, the combination of:
   - a housing having a chamber defined by a radially outer spherical wall, a radially inner spherical wall and opposed generally radially extending side walls interconnecting said spherical walls;
   - a shaft journalled within said housing and having an angularly offset portion within said chamber; and
   - a rotor having a generally spherical hub within said chamber and journalled on said shaft, said rotor hub having raised bearing areas in sliding engagement with said inner spherical surface, said hub carrying sealing means in engagement with said inner spherical wall to establish a seal between said hub and said inner spherical wall, said sealing means being separated from said raised bearing areas by regions on said hub spaced from said inner spherical wall.

4. The slant axis rotary mechanism of claim 3 wherein said sealing means comprise spaced compression and oil seals, said raised bearing areas being located between said compression and oil seals.

5. The slant axis rotary mechanism of claim 1 further including means for adjusting the loading on said raised bearing areas.

6. The slant axis rotary mechanism of claim 5 wherein said shaft is journalled in said housing by spaced bearings, and wherein said adjusting means comprise first and second housings for each of said bearings, said first housings containing said bearings and having outer surfaces whose centers are eccentric with respect to the corresponding bearing, said second housings containing said first housings and having an outer surface whose center is eccentric with respect to the corresponding first housing.

* * * * *